US006367174B1

(12) United States Patent
Shibata

(10) Patent No.: US 6,367,174 B1
(45) Date of Patent: Apr. 9, 2002

(54) INSOLE OR SOLE OF SHOES AND MANUFACTURING METHOD THEREOF

(75) Inventor: Osamu Shibata, Tokyo (JP)

(73) Assignee: Kabushiki Kaisha Himiko, Tokyo (JP)

( * ) Notice: Subject to any disclaimer, the term of this patent is extended or adjusted under 35 U.S.C. 154(b) by 0 days.

(21) Appl. No.: 09/351,651

(22) Filed: Jul. 13, 1999

(30) Foreign Application Priority Data

Feb. 23, 1999 (JP) ..... 11-044730

(51) Int. Cl.[7] ..... A61F 5/14; A43B 13/20
(52) U.S. Cl. ..... 36/141; 36/29; 36/44
(58) Field of Search ..... 36/141, 29, 44, 36/43

(56) References Cited

U.S. PATENT DOCUMENTS 4,744,157 A * 5/1988 Dubner
5,189,816 A * 3/1993 Shibata
5,365,678 A * 11/1994 Shibata

FOREIGN PATENT DOCUMENTS

| | | |
|---|---|---|
| FR | 2591441 | 6/1987 |
| WO | WO 9423603 | 10/1994 |
| WO | WO 9725551 | 7/1997 |

* cited by examiner

*Primary Examiner*—Ted Kavanaugh
(74) *Attorney, Agent, or Firm*—Jordan and Hamburg LLP

(57) ABSTRACT

A recess portion 12 and a thick outer peripheral portion 13 are formed in an upper surface of a bottom plate 1. A recess portion 21 is formed in a lower surface of a cover 2. The recess portions 12 and 21 have configurations corresponding to a combination of a tarsal portion of a foot covering an area from a heel to substantially a center portion of a foot and a metatarsal portion of the foot covering an area from the center portion to roots of toes of the foot, respectively. A plurality of blades 11 are integrally formed on a surface of the recess portion 12, extend in directions perpendicular to a longitudinal direction of the bottom plate and are slanted toward a heel portion of the bottom plate. The welded portions 3 and 4 of the upper surface of the bottom plate 1 and the lower surface of the cover, which directly surround the respective recess portions and have uniform width, are welded together by a high frequency welder and fluid is sealed in a space defined by the recess portions 12 and 21. Since the width of the welded portions 3 and 4 is uniform, the adhering strength becomes uniform, so that a water leakage can be prevented. Further, the insole or sole of shoe can massage a sole of foot while absorbing shock during walking, with reliable welding of the bottom plate and the cover.

6 Claims, 5 Drawing Sheets

INSOLE OR SOLE OF SHOES AND MANUFACTURING METHOD THEREOF

BACKGROUND OF THE INVENTION AND RELATED ART STATEMENT

The present invention relates to an insole or sole of shoes which seeks an effect of shock absorption during walking and also a massage effect owing to excitement of the sole of foot while providing for a stable and comfortable sense of wear.

The applicant has earlier proposed a sole or insole of shoes, which absorbs shock during walking while massaging a sole of foot by excitement thereof. The proposed sole or insole of shoes comprises a bottom plate, a plurality of blades formed integrally thereon, a cover with an outer periphery thereof bonded to an outer periphery of the bottom plate and fluid sealed in between the bottom plate and the cover. In more detail, a recess portion having a shape corresponding to a sole of foot is formed in an upper surface of the bottom plate. The blades are integrally formed on a bottom surface of the recess portion of the bottom plate. The blades are slanted and extend in directions perpendicular to a longitudinal direction of the bottom plate. The cover is formed with a recess portion having a shape corresponding to the sole of foot and an outer peripheral portion having a predetermined width surrounding the recess portion. The outer peripheral portion of the cover is welded to the outer peripheral portion of the bottom plate (cf. Japanese Patent No. 2549602, U.S. Pat. Nos. 5,189,816 or 5,365,678).

Further, the applicant has also proposed another sole or insole of shoes, in which grooves are formed in a middle portion of each of a plurality of blades so that fluid can be moved through these grooves. Outer end portions of a plurality of blades are connected to an inner end of a bottom plate through respective webs, each of which is lower than the blade to allow the fluid to pass therethrough (cf. Japanese Patent No. 1959712).

These proposals have been practically utilized in public favor.

The conventional insole or sole of shoes massages a sole of foot by excitement thereof during walking. It is general that, in walking, a heel portion of the sole of foot is landed, first, and, then, a tarsal portion of the sole, which includes an area of the sole from the heel to a substantial center portion of the sole is landed. Then, a metatarsal portion of the sole, which includes an area from the tarsal sole portion to roots of toes, is landed and, finally, the toes kick the land. By repeating these motions by the feet alternately, a wearer of the shoes can walk.

The recess portions of both the bottom plate and the cover of the conventional insole or sole of shoes, which are necessary for absorbing shock and massaging the sole of foot during walking, correspond in shape and size to the whole sole of foot including the toes and a space defined by these recess portions is filled with the fluid. Therefore, the kicking force of the toes during walking is absorbed by the fluid, causing the walking to be difficult. This difficulty may be similar to a case of walking on the sands. It has been found that this difficulty causes feet of some people, who have peculiarities in walking, troubles of internal organ and/or troubles of physiological function, to become numbing or painful, although this may cause no problem for normal people even when they walk for long time while exciting the effective spots existing in the roots of toes.

In the conventional insole or sole of shoes, the whole area of the bottom plate and the whole area of the cover, except their recess portions, are completely welded to each other by means of a high frequency welder and the whole welded area includes a relatively wide portion in front of the toes of the foot and narrow portions on both sides of the recess portions. Therefore, if a high frequency of high power is used in order to obtain a predetermined welding strength in the relatively wide portion, the welding strength of the whole welded area becomes non-uniform, causing the whole insole or sole to be distorted and/or causing the fluid to leak.

Further, the conventional blades are rectangle, have the grooves in the middle portions thereof and have the opposite end portions connected to an inner wall of the edge portions of the bottom plate through the webs. Therefore, in order to mold such blades, a metal mold having complicated configuration is required and the molding work itself is complicated. Further, in order to make the flow of fluid smooth, it is necessary to widen space through which the fluid flows, by making the blades higher than the webs by a predetermined amount. Therefore, the blades become so high that the thickness of the bottom plate has to be increased. This limits the wearing comfortableness of shoes and the freedom of design thereof.

Further, according to the conventional injection molding method of the bottom plate and the cover, which constitute the insole or sole of shoes, a gate of an injection molding metal mold is positioned in a location corresponding to an arch portion of foot. Therefore, a weld line of the injection molded bottom plate and the cover is frequently provided in a location on the side opposite to the position of the gate, which corresponds to an intermediate portion between a little toe and a second toe of foot. Further, a largest pressure is applied to the location of the insole or sole corresponding to the intermediate portion between the little toe and the second toe, during walking. Therefore, there is a problem that the fluid filing the space defined by the recesses tends to leak from a portion corresponding to the intermediate portion between the little toe and the second toe.

OBJECT AND SUMMARY OF THE INVENTION

An object of the present invention is to provide an insole or sole of shoes, which absorbs shock during walking and massages a sole of foot owing to excitement of the sole of foot, while giving a stable and conformable sense of wear, has a plurality of easily formable blades and can prevent fluid from leaking by making a welding of a bottom plate and a cover reliable, and a manufacturing method of the insole or sole of the shoes.

Another object of the present invention is to provide an insole or sole of shoes, which has a bottom plate formed with a recess corresponding in configuration to a combination of the tarsal and metatarsal portions of foot, provides a stable and comfortable sense of walking unlike the unstable feeling of walking on the sands and does not provide any pain even when a wearer walks for a long time since the effective point existing in roots of toes is not excited at all or is substantially not excited.

Another object of the present invention is to provide an insole or sole of shoes, which has a plurality of blades formed on a bottom surface of a recess of a bottom plate and each having an arc ridge so that spaces are provided between opposite end portions of the arc blades and an inner wall of the recess portion of the bottom plate. With such simple structure of the blades, a manufacture of the metal mold therefor and the molding operation become simple.

A further object of the present invention is to provide an insole or sole of shoes, which has a plurality of arc shaped blades formed on a bottom surface of a recess portion of a bottom plate, end portions of the blades located in an area corresponding to an area between a little toe and a second toe or located in an area corresponding to an area between the little toe and a big toe being swollen so that a leakage of fluid by pressure can be prevented more reliably.

Another object of the present invention is to provide an insole or sole of shoes, in which a bottom plate having a recess portion and a cover having a recess portion are joined together by welding peripheral portions of the bottom plate and the cover, which directly surround the respective recess portions and have a uniform width, together so that, even if a high power, high frequency is used in order to obtain a predetermined welding strength, there is no twisting phenomenon of the whole insole or sole of shoes and the leakage of fluid can be prevented more reliably.

Another object of the present invention is to provide an insole or sole of shoes, in which a non-welded portion of the bottom plate and the cover is spot-welded in order to prevent sands or dusts from entering into between the non-welded bottom plate and the non-welded cover, in which an uneven pattern is formed in an upper surface of the cover in order to promote diffusion and evaporation of sweat and/or in which a sheet is attached to a lower surface of the bottom plate in order to reduce uncomfortableness when fluid leaks during walking.

The present invention resides in an insole or sole of shoes, which comprises a bottom plate, a plurality of blades formed integrally with the bottom plate, a cover welded to a peripheral portion of the bottom plate and fluid sealed in a space defined between the bottom plate and the cover, the bottom plate being formed of a thermoplastic resin and having a recess portion formed in an upper surface thereof, the blades formed in the recess of the bottom plate and extending in directions perpendicular to a longitudinal direction of the bottom plate and slanted toward a heel, wherein the recess portion formed in the upper surface of the bottom plate has a configuration corresponding to a tarsal portion of a sole of foot and a metatarsal portion of the sole of foot. The size of the recess portion may be the same as that of the tarsal portion and the metatarsal portion of foot or smaller analogously. It is preferable that a front-end portion of the recess portion does not reach roots of toes.

Each of the blades has an arc ridge form with opposite end portions being sloped gently down. There are provided spaces between the opposite end portions of the blades and an inner wall of the recess portion of the bottom plate. It is preferable that one end portions of some of the blades, which are located in an area corresponding to an area between a little toe and a second toe of foot may be swollen compared with the other end portions in order to reduce fluid pressure at those end portions of the blades.

In the insole or sole of the present invention, the bottom plate having the recess portion and the cover having the recess portion are joined together by welding the peripheral portions directly surrounding the respective recesses and having the uniform width together and the area surrounding the welded portion are not welded. It is preferable that surfaces of the bottom plate and the cover, which are not welded together, are spot-welded at a plurality of points. Further, it is preferable to form the uneven pattern on the cover. Further, it is preferable to attach the sheet to the lower surface of the bottom plate. The fluid has low permeability, is hardly evaporated and gets hardly bad. An antifreeze agent may be added to the fluid.

DETAILED DESCRIPTION OF PREFERRED EMBODIMENTS

An insole or sole of shoes according to the present invention is constructed with a bottom plate 1, a plurality of blades 11 . . . (111~114) integrally formed on the bottom plate, a cover 2 bonded to the bottom plate and fluid injected into between the bottom plate and the cover.

Figure 1:
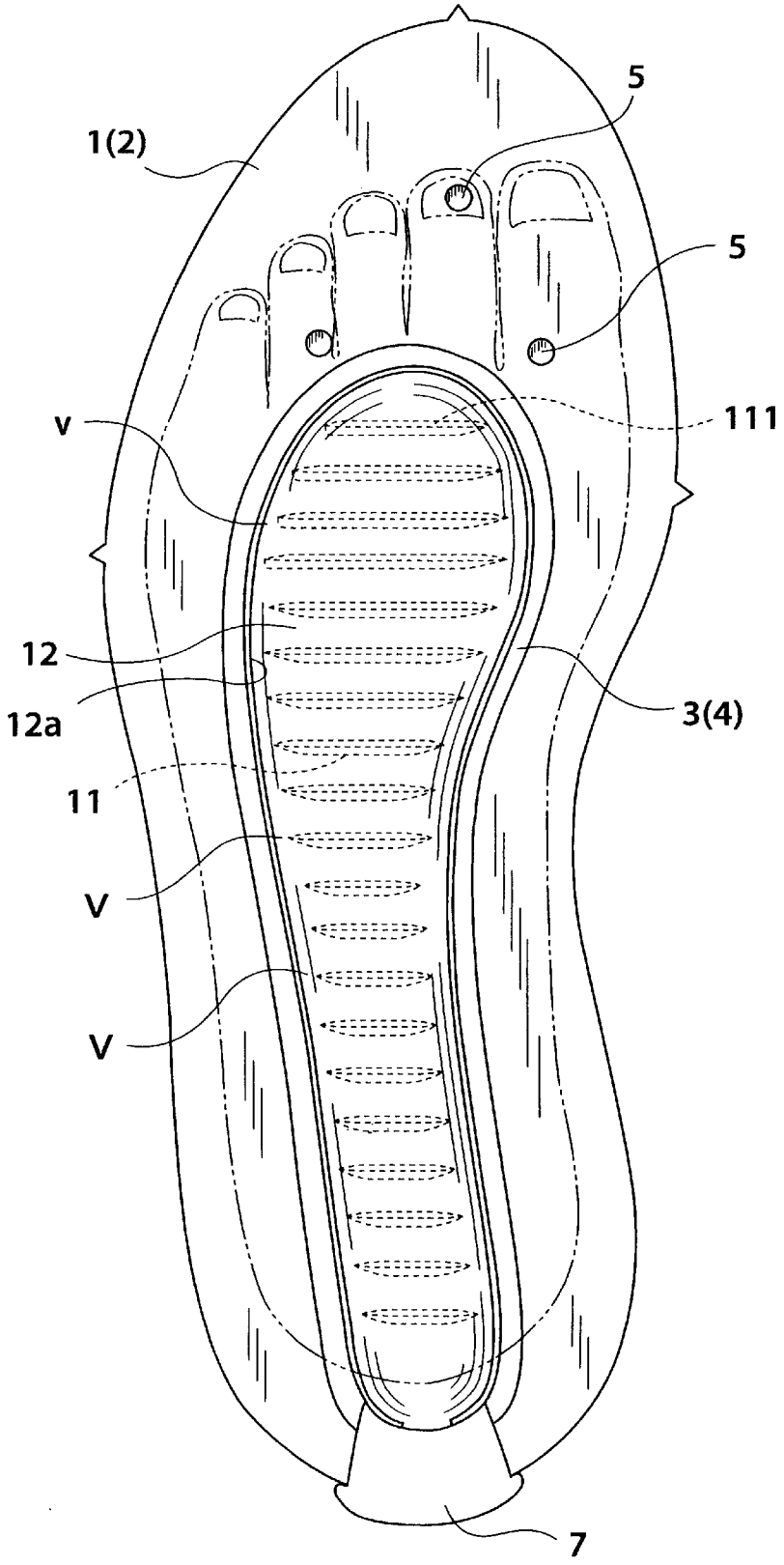
FIG. 1 is a plan view of an insole or sole of shoes according to an embodiment of the present invention.
Figure 2:
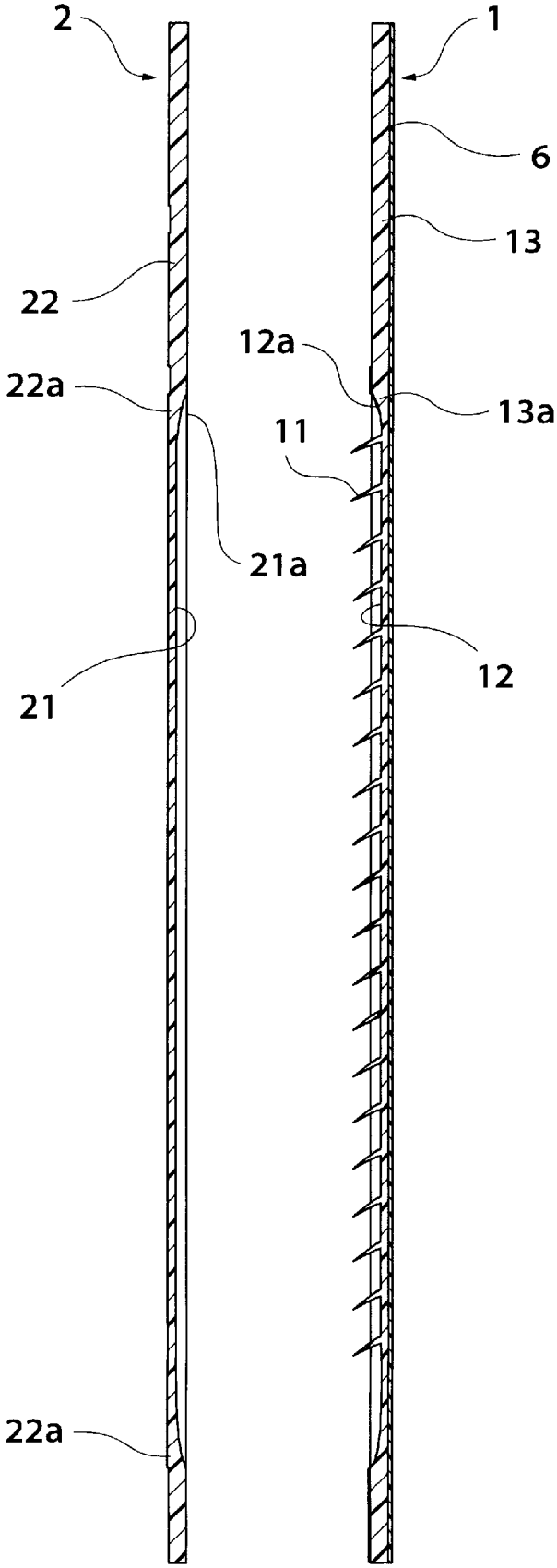
FIG. 2 is a cross section taken along a longitudinal direction of the insole or sole shown in FIG. 1.
Figure 3:
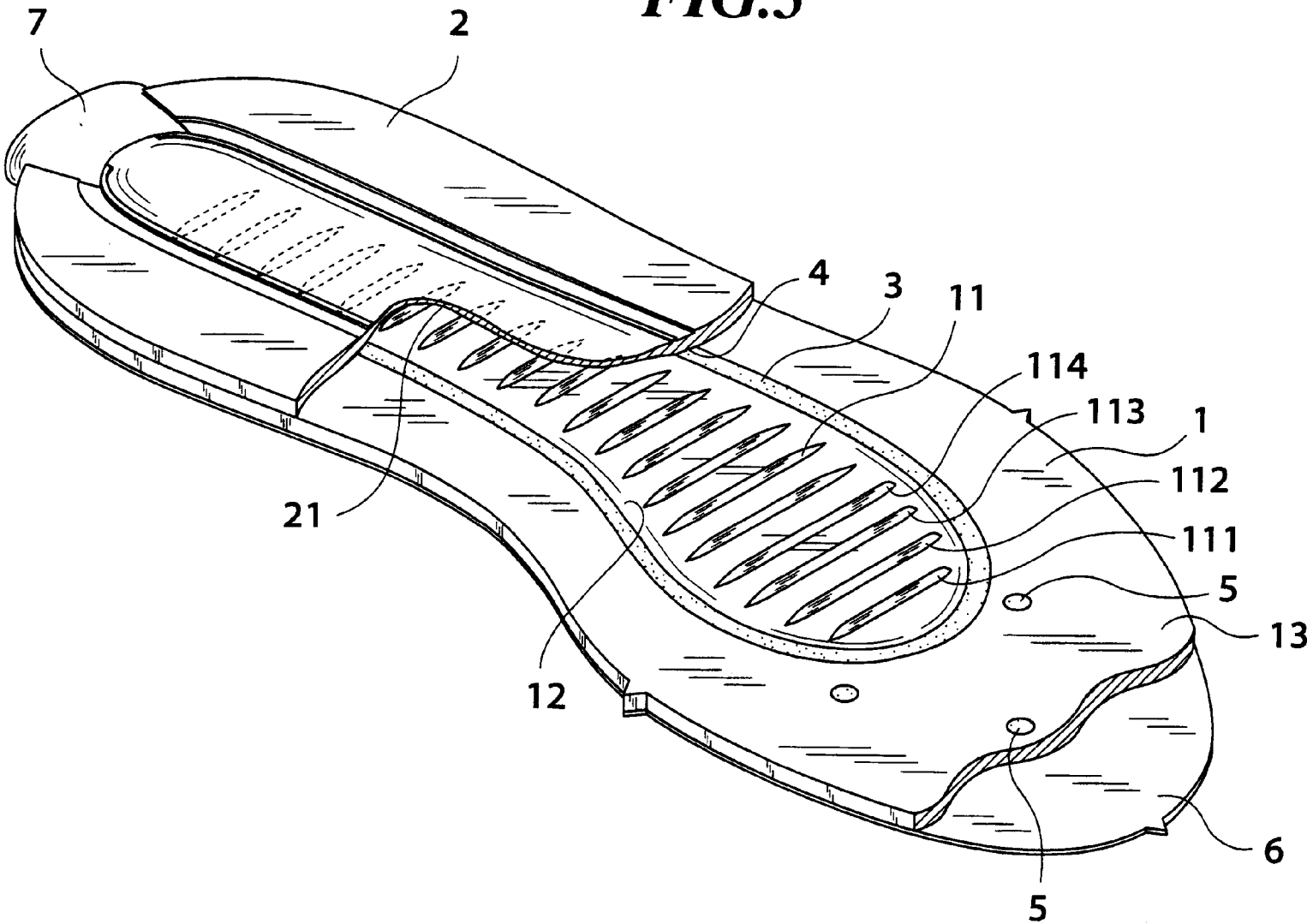
FIG. 3 is a partially cut-away, perspective view of the insole or sole shown in FIG. 1.

Describing a structure of the bottom plate 1 for a left foot with reference to FIGS. 1 to 3, the bottom plate 1 is integrally formed by an injection molding of thermoplastic resin. A recess portion 12 is formed in an upper surface of the bottom plate 1, leaving a thick outer peripheral portion 13. The recess portion 12 corresponds, in shape and size, to a combination of a tarsal portion of the foot covering a heel to substantially a center portion of the foot and a metatarsal portion covering an area from the tarsal portion to the roots of toes. It should be noted that the recess portion 12 may be analogously smaller in size than the shown recess portion. Although a front-end portion of the recess portion 12 may reach the roots of the toes, it is preferable that the front-end portion of the recess portion 12 does not reach the roots of toes. A plurality of blades 11 . . . ,111,112,113,114 are integrally formed on a bottom plate of the recess portion 12. The blades 11 extend in directions perpendicular to a longitudinal direction of the bottom plate 1 and are slanted toward the heel as shown in FIG. 2.

Figure 5A:
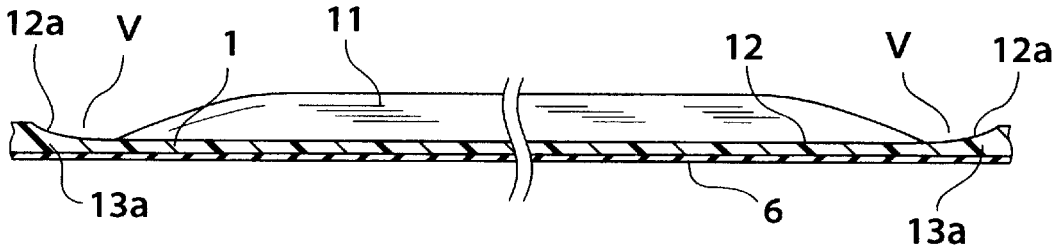
FIG. 5(A) is an enlarge, partially cut-away cross section taken along a line a—a in FIG. 4.

Each blade 11 takes in the form of a thin arc ridge having a smooth ridgeline as shown in FIG. 5(A). Since the opposite end portions of the ridge are separated from a concaved inner wall 12*a* of the recess portion 12 and the opposite end portions of the blades 11 do not reach the concaved inner wall 12*a* of the recess portion 12 as show in FIG. 5(A), large spaces V are provided between the end portions of the blades 11 and the inner wall 12*a* of the recess 12 so that the movement of fluid is facilitated through the spaces V.

Figure 4:
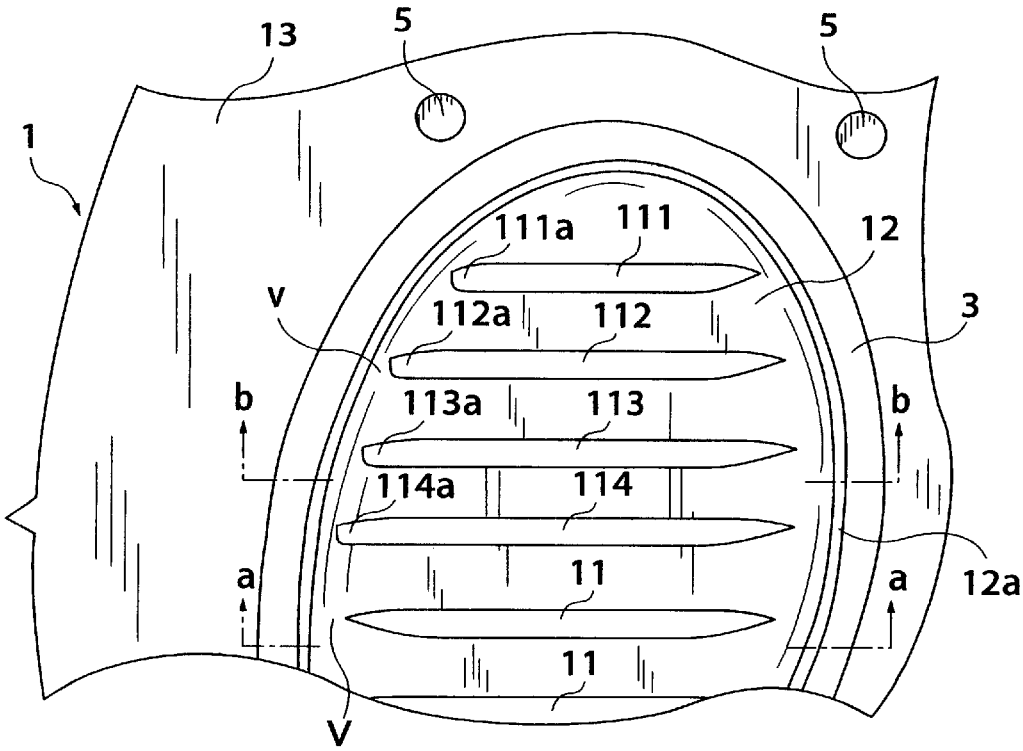
FIG. 4 is an enlarge plan view of a bottom plate of the insole or sole shown in FIG. 1.
Figure 5B:
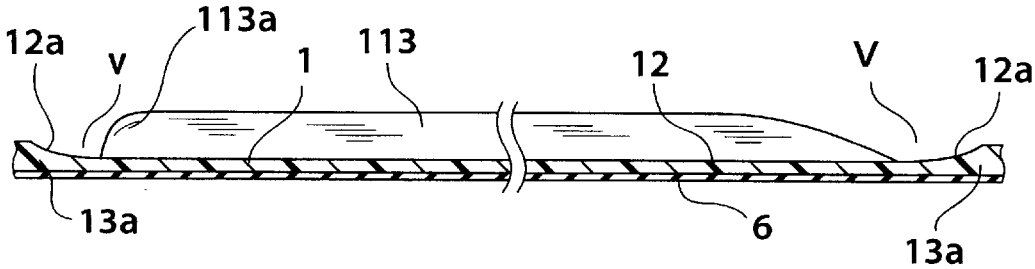
FIG. 5(B) is an enlarge, partially cut-away cross section taken along a line b—b in FIG. 4.

Among the blades 11, those formed in a front-end portion of the recess 12 are depicted by reference numerals 111, 112, 113 and 114. The blades 111, 112, 113 and 114 have left side end portions 111*a*, 112*a*, 113*a* and 114*a* corresponding in position to the area between the little toes and the second toe as shown in FIG. 4. The left side end portions 111*a*, 112*a*, 113*a* and 114*a* are swollen compared with those of the other blades to form of thick and sharp edge portions having large curvature, compared with those of the blades 11, as shown in FIG. 5(B). Therefore, the space v between the inner wall 12*a* of the recess portion 12 and the left side end portion of the blade 113, for example, is smaller than the space V provided by the blade 11, so that the fluid pressure caused by an external pressing force is reduced by the left side end portions 111*a* to 114*a* to thereby reduce the movement of fluid.

As mentioned previously, the inner wall 12*a* of the recess portion 12 of the bottom plate 1 has the concaved configuration having a thicker portion 13*a* so that the thickness of the bottom plate 1 becomes continuously larger toward the outer peripheral portion 13 of the bottom plate 1.

An area of a front half of the outer peripheral portion 13 of the recess portion 12 of the bottom plate 1 is made larger than that of the opposite side portions of the outer peripheral portion 13, in order to regulate the size and/or shape of the outer peripheral portion concomitantly with the size and/or shape of shoes, to which the insole or sole of the present invention is applied, by partially cutting away the front half portion of the outer peripheral portion 13 of the bottom plate 1 suitably. The blades 11 protrude from the surface of the outer peripheral portion 13 of the bottom plate 1. Therefore, in an assembled state of the insole or sole of shoes, the blades 11 are resiliently bent by a recess portion 21 of the cover 2, so that the blades 11 can excite the sole of foot through the cover 2 to thereby massage the sole of foot.

The cover 2 is formed of thermoplastic synthetic resin similar to the thermoplastic resin used to form the bottom plate 1. The cover 2 has an outer peripheral portion 22 surrounding the recess portion 21. The configurations of the recess portion 21 and the outer peripheral portion 22 are the same as the configurations of the recess portion 12 and the outer peripheral portion 13 of the bottom plate 1, respectively, and the thickness of the outer peripheral portion 22 of the cover 2 is the same as that of the outer peripheral portion 13 of the bottom plate 1. A thicker portion 22*a* is formed in an inner wall 21*a* of the recess portion 21 of the cover 2 so that the thickness of the cover 2 becomes continuously larger toward the outer peripheral portion 22. An uneven patten 23, for example, aventurine pattern is formed on the surface of the cover 2 in order to prevent sweat droplets from staying on the upper surface of the cover while promoting diffusion and evaporation of sweat.

In bonding the bottom plate 1 and the cover 2 together, the outer peripheral portions 13 and 22 of the bottom plate 1 and the cover 2, which have the same thickness, are mated and welded together by high frequency welder, welded portions 3 and 4 having uniform widths and provided in inner peripheral portions of the outer peripheral portions 12 and 22. The portions of the outer peripheral portions 12 and 22 outside the weld portions are left non-welded. Since the widths of the weld portions 3 and 4 are uniform throughout thereof, the adhesive strength is uniform, so that it is possible to maintain the whole insole or sole of shoes flat and to prevent fluid leakage. Further, the non-welded portions of the bottom plate and the cover are spot-welded at three points 5 as shown in FIG. 1. Therefore, invasion of sands or dusts to the adhering surfaces, which are not completely welded, can be prevented.

Further, a sheet 6, is adhered to a lower surface of the bottom plate 1 as shown in FIGS. 2, 3 and 5. Therefore, if the fluid permeated through the bottom plate, uncomfortable feeling during walking due to the leakage can be reduced by the sheet 6.

Then, after the bottom plate 1 and the cover 2 are welded together as mentioned above, the fluid, such as water, is injected from an inlet 7 (FIGS. 1 and 3) to the space defined by the recess portions 12 and 21 and, then, the inlet 7 is sealed by melting it. The fluid may be a solution, which has low permeability, hardly evaporates, has high flowability and hardly gets bad. Further, since, in a cold district, the fluid may be frozen and the so-called puncture may occur, it is preferable to mix an antifreeze agent in the fluid. When propylene glycol is mixed in the fluid as the antifreeze agent, it is possible to prevent a reduction of shock absorbing performance due to natural evaporation of the fluid.

When a wearer of the shoes having the sole constructed as mentioned above or shoes in which the insole constructed as mentioned above is inserted walks step by step, the fluid moves in the space defined by the recesses 12 and 21 reciprocally at random in directions perpendicular to the longitudinal direction of the bottom plate along the respective blades as well as in directions parallel to the longitudinal direction through the spaces V and v at the opposite ends of the blades. Therefore, the shock during walking is absorbed by the fluid and the soles of feet are excited by the resilient blades having resiliency lowered by the fluid to continuously massage the soles of feet to thereby remove pain caused by a long walking, and, thus a stable and comfortable feeling of walking is given to the wearer.

Figure 6:
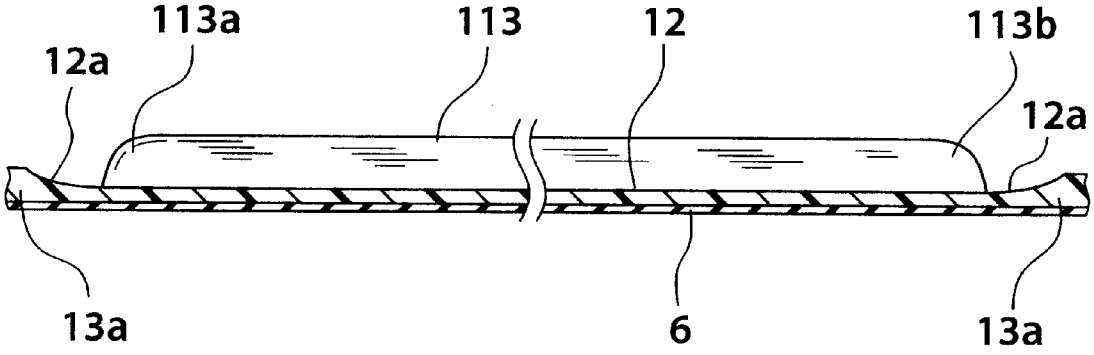
FIG. 6 is an enlarged, partially cut-away cross section of another embodiment of the present invention.

Although, in the described embodiment, the curvature of the outside end portions 111*a*, 112*a*, 113*a* and 114*a* of the blades 111, 112, 113 and 114, which correspond to the area between the little toe and the second toe is made larger, the curvature of the other end portions 111*b*, 112*b*, 113*b* and 114*b* of the blades 111 to 114 may be made larger, too, in order to reduce the fluid pressure on the both end portions, as shown in FIG. 6. Incidentally, only the blade 113 is shown in FIG. 6.

An injection molding method for formed the bottom plate 1 and the cover 2, which constitute the insole or sole of shoes, will be described. The gate of the injection metal mold is positioned in a location outside the foot, which is opposite to the location of the gate of the conventional metal mold, such that the weld line is formed on the side of the arched portion of the bottom plate 1 and the cover 2. Since the pressure applied to the arched portion of the bottom plate 1 or the cover 2 during walking is lowest, this is effective in preventing a leakage of fluid sealed in the insole or sole of shoes.

What is claimed is:

1. An insole of a shoe, comprising:

a bottom plate formed with a recess portion in an upper surface thereof;

a plurality of blades integrally formed on a bottom surface of said recess portion of said bottom plate, the plurality of said blades extending in directions perpendicular to a longitudinal direction of said bottom plate and slanted toward a heel portion of said bottom plate;

a cover adhered to a peripheral portion of said bottom plate, said peripheral portion surrounding said recess portion, said cover being welded to said bottom plate along a peripheral line having a uniform width and directly surrounding said recess portion of said bottom plate, a remaining portion of said peripheral portion of said bottom plate being left generally non-welded; and fluid sealed in a space defined between said bottom plate and said cover.

2. A sole of a shoe comprising:

a bottom plate formed of a thermoplastic resin material, said bottom plate being formed with a recess portion in an upper surface thereof, said recess portion having a configuration corresponding to a combination of a tarsal portion of a foot, covering an area from a heel to substantially a center portion of the foot and a metatarsal portion of the foot, covering an area from the tarsal portion to roots of toes of the foot;

a plurality of blades integrally formed on a bottom surface of said recess portion of said bottom plate, the plurality of said blades extending in directions perpendicular to a longitudinal direction of said bottom plate and slanted toward a heel portion of said bottom plate, each said blade having an arc ridge;

spaces provided between an inner wall of said recess portion of said bottom plate and opposite end portions of said blades;

a cover adhered to a peripheral portion of said bottom plate, said peripheral portion of said bottom plate surrounding said recess portion of said bottom plate; and fluid sealed in a space defined between said bottom plate and said cover;

wherein, in order to reduce fluid pressure, end portions of said blades positioned in an area of said recess portion corresponding to an area of the foot between a little toe and a second toe of the foot are swollen compared with the other end portions of said blades.

3. A sole of a shoe comprising:

a bottom plate formed of a thermoplastic resin material, said bottom plate being formed with a recess portion in an upper surface thereof, said recess portion having a configuration corresponding to a combination of a tarsal portion of a foot, covering an area from a heel to substantially a center portion of the foot and a metatarsal portion of the foot, covering an area from the tarsal portion to roots of toes of the foot;

a plurality of blades integrally formed on a bottom surface of said recess portion of said bottom plate, the plurality of said blades extending in directions perpendicular to a longitudinal direction of said bottom plate and slanted toward a heel portion of said bottom plate, each said blade having an arc ridge;

spaces provided between an inner wall of said recess portion of said bottom plate and opposite end portions of said blades;

a cover adhered to a peripheral portion of said bottom plate, said peripheral portion of said bottom plate surrounding said recess portion of said bottom plate; and fluid sealed in a space defined between said bottom plate and said cover;

wherein, in order to reduce fluid pressure, opposite end portions of said blades positioned in an area of said recess portion corresponding to an area of the foot between a little toe and a big toe of the foot are swollen compared with the other end portions of said blades.

4. A sole of a shoe, comprising:

a bottom plate formed with a recess portion in an upper surface thereof;

a plurality of blades integrally formed on a bottom surface of said recess portion of said bottom plate, the plurality of said blades extending in directions perpendicular to a longitudinal direction of said bottom plate and slanted toward a heel portion of said bottom plate;

a cover adhered to a peripheral portion of said bottom plate, said peripheral portion surrounding said recess portion, said cover being welded to said bottom plate along a peripheral line having a uniform width and directly surrounding said recess portion of said bottom plate, a remaining portion of said peripheral portion of said bottom plate being left generally non-welded; and fluid sealed in a space defined between said bottom plate and said cover.

5. An insole of a shoe comprising:

a bottom plate formed of a thermoplastic resin material, said bottom plate being formed with a recess portion in an upper surface thereof, said recess portion having a configuration corresponding to a combination of a tarsal portion of a foot, covering an area from a heel to substantially a center portion of the foot and a metatarsal portion of the foot, covering an area from the tarsal portion to roots of toes of the foot;

a plurality of blades integrally formed on a bottom surface of said recess portion of said bottom plate, the plurality of said blades extending in directions perpendicular to a longitudinal direction of said bottom plate and slanted toward a heel portion of said bottom plate, each said blade having an arc ridge;

spaces provided between an inner wall of said recess portion of said bottom plate and opposite end portions of said blades;

a cover adhered to a peripheral portion of said bottom plate, said peripheral portion of said bottom plate surrounding said recess portion of said bottom plate; and fluid sealed in a space defined between said bottom plate and said cover;

wherein, in order to reduce fluid pressure, opposite end portions of said blades positioned in an area of said recess portion corresponding to an area of the foot between a little toe and a big toe of the foot are swollen compared with the other end portions of said blades.

6. An insole of a shoe comprising:

a bottom plate formed of a thermoplastic resin material, said bottom plate being formed with a recess portion in an upper surface thereof, said recess portion having a configuration corresponding to a combination of a tarsal portion of a foot, covering an area from a heel to substantially a center portion of the foot and a metatarsal portion of the foot, covering an area from the tarsal portion to roots of toes of the foot;

a plurality of blades integrally formed on a bottom surface of said recess portion of said bottom plate, the plurality of said blades extending in directions perpendicular to a longitudinal direction of said bottom plate and slanted toward a heel portion of said bottom plate, each said blade having an arc ridge;

spaces provided between an inner wall of said recess portion of said bottom plate and opposite end portions of said blades;

a cover adhered to a peripheral portion of said bottom plate, said peripheral portion of said bottom plate surrounding said recess portion of said bottom plate; and fluid sealed in a space defined between said bottom plate and said cover;

wherein, in order to reduce fluid pressure, end portions of said blades positioned in an area of said recess portion corresponding to an area of the foot between a little toe and a second toe of the foot are swollen compared with the other end portions of said blades.

* * * * *